US008134522B2

(12) United States Patent
Yonezawa

(10) Patent No.: US 8,134,522 B2
(45) Date of Patent: Mar. 13, 2012

(54) LED DRIVING CIRCUIT

(75) Inventor: Yoshiaki Yonezawa, Gunma-ken (JP)

(73) Assignees: Semiconductor Components Industries, LLC, Phoenix, AZ (US); Sanyo Semiconductor Co., Ltd., Gunma (JP)

( * ) Notice: Subject to any disclaimer, the term of this patent is extended or adjusted under 35 U.S.C. 154(b) by 887 days.

(21) Appl. No.: 12/189,003

(22) Filed: Aug. 8, 2008

(65) Prior Publication Data

US 2009/0040139 A1 Feb. 12, 2009

(30) Foreign Application Priority Data

Aug. 8, 2007 (JP) ..... 2007-206927

(51) Int. Cl.
*G09G 3/14* (2006.01)

(52) U.S. Cl. ..... 345/46; 345/33; 345/44

(58) Field of Classification Search ..... 345/33–54, 345/82; 340/815.45
See application file for complete search history.

(56) References Cited

U.S. PATENT DOCUMENTS 3,992,873 A * 11/1976 Awalt ..... 368/68
4,727,367 A * 2/1988 Noda ..... 345/211
5,547,507 A * 8/1996 Ciaramita ..... 118/13
6,005,538 A * 12/1999 Hoekstra ..... 345/47
6,097,302 A * 8/2000 Zinzell ..... 340/815.44
6,310,590 B1 * 10/2001 Havel ..... 345/83
7,483,003 B2 * 1/2009 Nogawa ..... 345/82
2001/0015708 A1 * 8/2001 Havel ..... 345/83
2004/0087840 A1 * 5/2004 Main ..... 600/304

FOREIGN PATENT DOCUMENTS

JP 06-021839 1/1994

* cited by examiner

*Primary Examiner* — Amare Mengistu
*Assistant Examiner* — Dmitriy Bolotin
(74) *Attorney, Agent, or Firm* — SoCal IP Law Group LLP; Steven C. Sereboff; John E. Gunther

(57) ABSTRACT

An LED driving circuit includes: a current generating circuit configured to generate a drive current corresponding to a voltage level of a drive voltage applied to anodes of the first to fourth LEDs so as to alternately drive the first and second LEDs and the third and fourth LEDs; a first drive control circuit connected to cathodes of the first and third LEDs, and configured to drive the first or third LED with the drive current in response to a first control signal for controlling driving of the first or third LED; and a second drive control circuit connected to cathodes of the second and fourth LEDs, and configured to drive the second or fourth LED with the drive current in response to a second control signal for controlling driving of the second or fourth LED.

5 Claims, 5 Drawing Sheets

LED DRIVING CIRCUIT

CROSS-REFERENCE TO RELATED APPLICATION

This application claims the benefit of priority to Japanese Patent Application No. 2007-206927, filed Aug. 8, 2007, of which full contents are incorporated herein by reference.

BACKGROUND OF THE INVENTION

1. Field of the Invention

The present invention relates to an LED driving circuit.

2. Description of the Related Art

A clock having a radio reception function and digitally displaying time by LEDs is in wide use (see, e.g., Japanese Patent Application Laid-Open Publication No. 1994-21839). FIG. 5 depicts an example of a time display unit of such a clock. The time display unit 100 has a plurality of segments 110 to 116, etc., for digitally displaying a time, each of which is turned on by one LED. For example, out of seven segments 110 to 116 for displaying a ten-digit number in minute, four segments 110 to 113 are turned on to put "4" in display, or, two segments 112 and 113 are turned on to put "1" in display.

In this manner, an LED driving circuit is used as a circuit that controls driving of a plurality of LEDs. FIG. 6 depicts a general configuration example of an LED driving circuit. The LED driving circuit 120 is an integrated circuit that includes a plurality of drive control circuits 121, 122, etc., and a plurality of connection terminals T11, T12, etc. In the LED driving circuit 120, to reduce the number of terminals, one connection terminal is provided for every two LEDs. For example, the connection terminal T11 is provided for LEDs 130 and 131, and the connection terminal T12 is provided for LEDs 132 and 133. A drive voltage COM1 is applied to the anodes of the LEDs 130 and 132 via a resistance R11, and a drive voltage COM2 is applied to the anodes of the LEDs 131 and 133 via a resistance R12.

FIG. 7 depicts an example of the drive voltages COM1 and COM2. The drive voltages COM1 and COM2 are, for example, obtained by rectifying an alternating voltage AC having a frequency of 50 Hz through half-wave rectification, and have phases different from each other by 180 degrees. When LEDs driven by the drive voltage COM1 are LEDs belonging to an A group and LEDs driven by the drive voltage COM2 are LEDs belonging to a B group, the LEDs in the A group and those in the B group are driven alternately. For example, the LEDs 130 to 133 correspond in increasing order to the segments 110 to 113 of the time display unit 100, respectively. For example, the LEDs 130 and 132 in the A group and the LEDs 131 and 133 in the B group are driven alternately at a frequency of, for example, 50 Hz to make a visual display of "4".

In this manner, according to the LED driving circuit 120, the LEDs are divided into two groups, and are driven by time-division driving. In each group, an LED corresponding to a time to display out of a plurality of LEDs is turned on, so that the number of LEDs to be turned on varies depending on the time to display. As the number of LEDs being on increases in the group, therefore, current flowing through each LED in the group decreases to reduce luminance. Thus, if the number of LEDs to be turned on is different between both groups depending on a time to display, luminance given by LEDs in the A group and that given by LEDs in the B group becomes different from each other, which results in luminance irregularity in time display.

SUMMARY OF THE INVENTION

An LED driving circuit according to an aspect of the present invention, includes: a current generating circuit configured to generate a drive current corresponding to a voltage level of a drive voltage applied to anodes of the first to fourth LEDs so as to alternately drive the first and second LEDs and the third and fourth LEDs; a first drive control circuit connected to cathodes of the first and third LEDs, and configured to drive the first or third LED with the drive current in response to a first control signal for controlling driving of the first or third LED; and a second drive control circuit connected to cathodes of the second and fourth LEDs, and configured to drive the second or fourth LED with the drive current in response to a second control signal for controlling driving of the second or fourth LED.

Other features of the present invention will become apparent from descriptions of this specification and of the accompanying drawings.

BRIEF DESCRIPTION OF THE DRAWINGS

For more thorough understanding of the present invention and advantages thereof, the following description should be read in conjunction with the accompanying drawings, in which.

DETAILED DESCRIPTION OF THE INVENTION

At least the following details will become apparent from descriptions of this specification and of the accompanying drawings.

Figure 1:
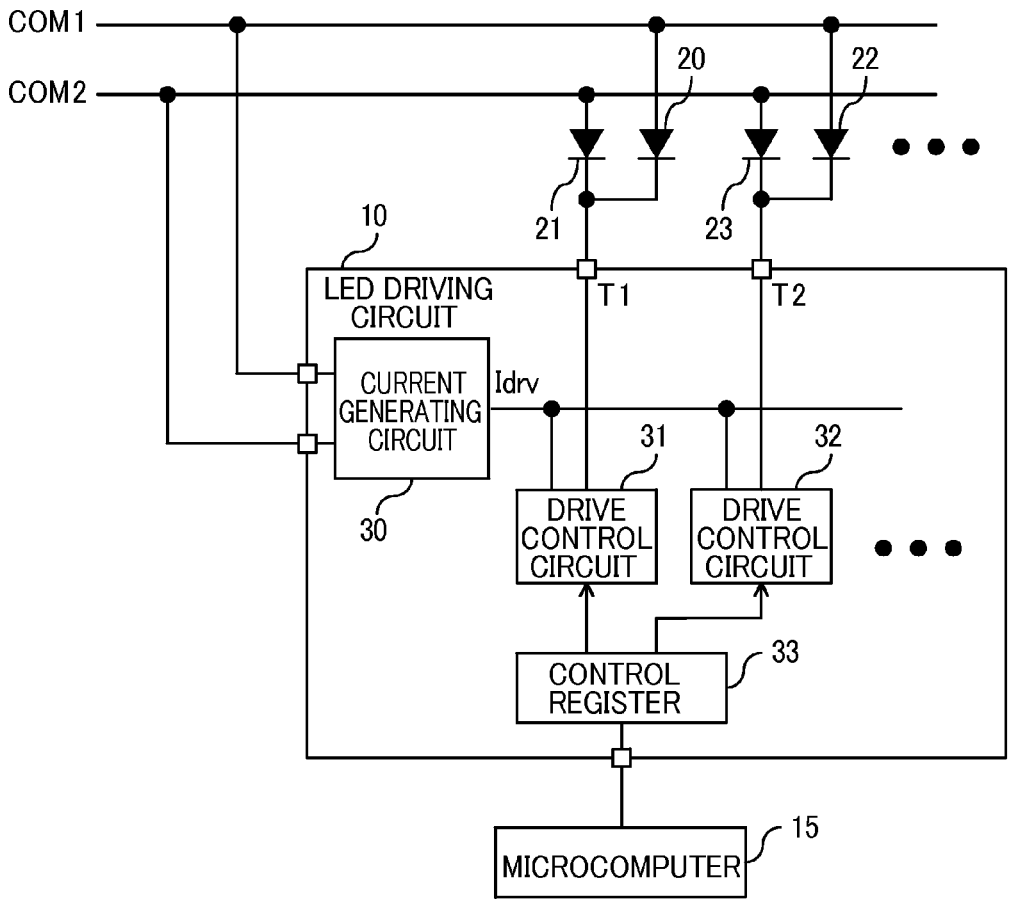
FIG. 1 depicts a configuration example of an LED driving circuit that is one embodiment of the present invention.

FIG. 1 depicts a configuration example of an LED driving circuit that is one embodiment of the present invention. The LED driving circuit 10 is an integrated circuit that drives a plurality of LEDs 20 to 23, etc., for digitally displaying a time on a clock having a radio reception function through control by a microcomputer 15. The LED driving circuit 10 includes a plurality of connection terminals T1, T2 etc., a current generating circuit 30, a plurality of drive control circuits 31, 32, etc., and a control register 33.

To reduce the number of terminals in the integrated circuit, two LEDs are connected to each of the connection terminals for connecting LEDs. For example, the LEDs 20 and 21 are connected to the connection terminal T1, and the LEDs 22 and 23 are connected to the connection terminal T2. The plurality of LEDs are divided into LEDs belonging to an A group in which a drive voltage COM1 is applied to the anodes of the LEDs, and into LEDs belonging to a B group in which a drive voltage COM2 is applied to the anodes of the LEDs. For example, the LED 20 (first LED) and the LED 22 (second LED) belong to the A group, and the LED 21 (third LED) and the LED 23 (fourth LED) belong to the B group.

Figure 2:
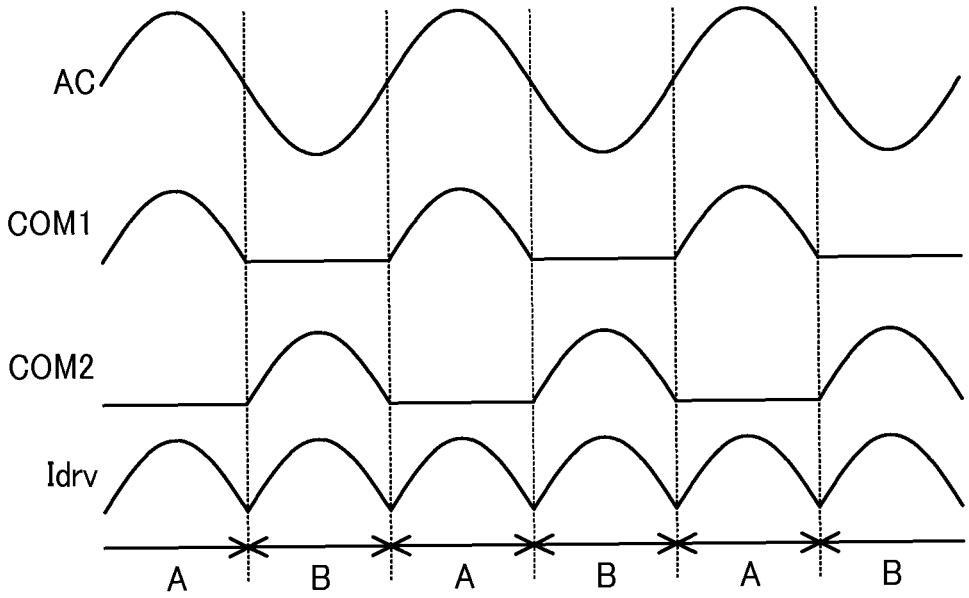
FIG. 2 depicts an example of a change in drive voltages and a drive current.

The current generating circuit 30 generates a drive current Idrv that corresponds to the voltage levels of the drive voltage COM1 (first drive voltage) and the drive voltage COM2 (second drive voltage). FIG. 2 depicts an example of a change in the drive voltages COM1 and COM2 and the drive current Idrv. The drive voltages COM1 and COM2 are, for example, obtained by rectifying an alternating voltage AC having a frequency of 50 Hz through half-wave rectification using a transformer, and have phases different from each other by 180 degrees. The drive current Idrv has a waveform that shifts in correspondence to half waves of the drive voltages COM1 and COM2, and is controlled so that the peak level of the drive current Idrv goes to a given level. Through these drive voltages COM1 and COM2 and drive current Idrv, the LEDs in the A group are driven in a period during which a half wave is generated in the drive voltage COM1, and the LEDs in the B group are driven in a period during which a half wave is generated in the drive voltage COM2.

The LEDs are driven by time-division driving by the gradually changing drive voltages COM1 and COM2, not by, for example, a sharply changing pulse-like voltage. This enables a reduction in noises that affects a radio reception circuit that is mounted together with the LED driving circuit 10.

The drive control circuit 31 (first drive control circuit) controls driving of the LEDs 20 and 21 based on a control signal (first control signal) output from the control register 33. The drive control circuit 32 (second drive control circuit) controls driving of the LEDs 22 and 23 based on a control signal (second control signal) output from the control register 33. For example, when a control signal output from the control register 33 gives an instruction for turning on the LEDs 20 and 22 in a period during which the LEDs in the A group are driven, the drive control circuit 31 causes the drive current Idrv to pass through the LED 20 while the drive control circuit 32 causes the drive current Idrv to pass through the LED 22. When a control signal output from the control register 33 gives an instruction for turning on the LEDs 21 and 23 in a period during which the LEDs in the B group are driven, the drive control circuit 31 causes the drive current Idrv to pass through the LED 21 while the drive control circuit 32 causes the drive current Idrv to pass through the LED 23. In this manner, the drive control circuits 31 and 32 drive each LED by the drive current Idrv not depending on the number of LEDs to be turned on in each group. Even if the number of LEDs to be turned is different in each group, therefore, the same current flows through each LED. Hence luminance irregularity is remedied.

The microcomputer 15 writes a control signal for controlling driving of each LED in correspondence to a time to display, to the control register 33. This control signal contains a control signal for controlling driving of the LEDs in the A group, and a control signal for controlling driving of the LEDs in the B group. Each of these two control signals is output in timing that matches drive timing of the LEDs in each group.

Figure 3:
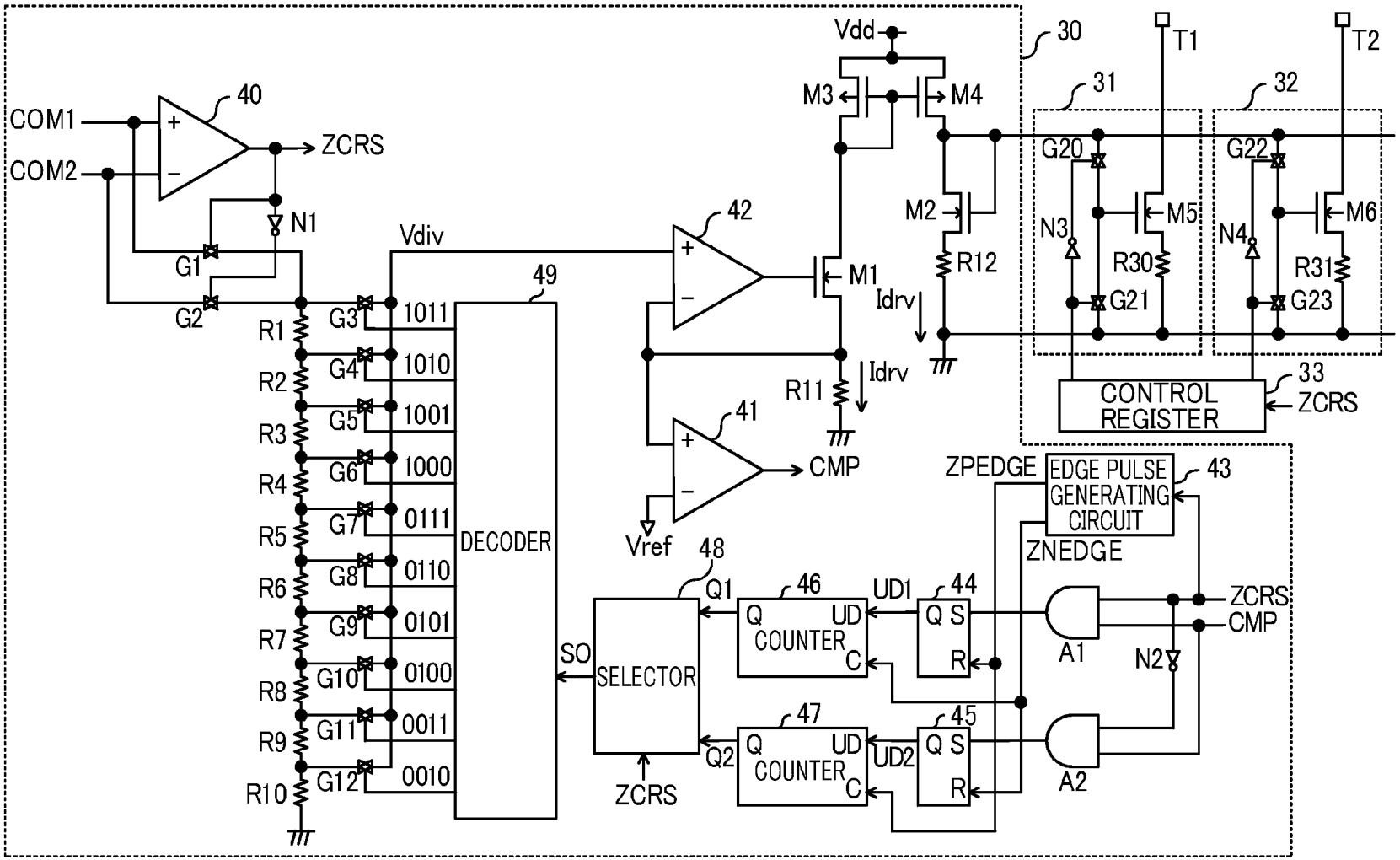
FIG. 3 depicts a configuration example of a current generating circuit and drive control circuits.

FIG. 3 depicts a configuration example of the current generating circuit 30 and the drive control circuits 31 and 32. The current generating circuit 30 includes comparators 40 and 41, an operating amplifier 42, an edge pulse generating circuit 43, RS flip-flops 44 and 45, counters 46 and 47, a selector 48, a decoder 49, AND circuits A1 and A2, NOT circuits N1 and N2, resistances R1 to R12, transfer gates G1 to G12, N-channel MOSFETs M1 and M2, and P-channel MOSFETs M3 and M4. The drive control circuit 31 includes an N-channel MOSFET M5, a resistance R30, transfer gates G20 and G21, and a NOT circuit N3. Likewise, the drive control circuit 32 includes an N-channel MOSFET M6, a resistance R31, transfer gates G22 and G23, and a NOT circuit N4.

The comparator 40 compares the voltage level of the drive voltage COM1 with that of the drive voltage COM2, and outputs a signal ZCRS indicating a comparison result. In the present embodiment, the signal ZCRS goes high when the voltage level of the drive voltage COM1 is higher than that of the drive voltage COM2, and goes low when the voltage level of the drive voltage COM1 is lower than that of the drive voltage COM2. This means that the LEDs in the A group are driven when the signal ZCRS is high, and that the LEDs in the B group are driven when the signal ZCRS is low.

The transfer gate G1 is a switch circuit that controls output of the drive voltage COM1 in response to the signal ZCRS input to the transfer gate G1. The transfer gate G2 is a switch circuit that controls output of the drive voltage COM2 in response to the signal ZCRS that is input to the transfer gate G2 via the NOT circuit N1. In the present embodiment, when the signal ZCRS is high, the transfer gate G1 turns on and the transfer gate G2 turns off. As a result, the drive voltage COM1 is applied to one end of the resistance R1. When the signal ZCRS is low, on the contrary, the transfer gate G1 turns off and the transfer gate G2 turns on. As a result, the drive voltage COM2 is applied to one end of the resistance R1.

A circuit composed of the comparator 40, the transfer gates G1 and G2, and the NOT circuit N1 is one example of a drive voltage selecting circuit of the present invention.

The resistances R1 to R10 and the transfer gates G3 to G12 compose a voltage dividing circuit that outputs a divided voltage Vdiv that is obtained by dividing the drive voltage COM1 or COM2 applied to one end of the resistance R1. Any one of the transfer gates G3 to G12 is turned on by a signal output from the decoder 49. This means that a voltage dividing ratio at the voltage dividing circuit can be changed by changing a transfer gate to be turned on among the transfer gates G3 to G12. For example, when a voltage applied to one end of the resistance R1 is at a given level, changing a transfer gate to be turned on in increasing order from the transfer gate G3 to the transfer gate G12 reduces the divided voltage Vdiv in the same order.

The operating amplifier 42, the N-channel MOSFETs M1 and M2, the P-channel MOSFETs M3 and M4, and the resistances R11 and R12 compose a voltage-to-current conversion circuit that generates the drive current Idrv that corresponds to the divided voltage Vdiv. The operating amplifier 42 has a positive input terminal to which the divided voltage Vdiv is applied, and a negative input terminal connected to one end of the resistance R11. Because of this, when the operating amplifier 42 operates, a voltage at one end of the resistance R11 becomes identical in level with the divided voltage Vdiv. When the resistance value of the resistance R11 is R11, therefore, the drive current Idrv is given by the equation: Idrv=Vdiv/R11. The P-channel MOSFETs M3 and M4 are connected in current mirror arrangement. If the P-channel MOSFETs M3 and M4 are identical in size, therefore, the drive current Idrv also flows through the P-channel MOSFETs M4, N-channel MOSFET M2, and the resistance R12.

The comparator 41 (comparing circuit) compares the divided voltage Vdiv with a reference voltage Vref at a given level, and outputs a signal CMP indicating a comparison result. The reference voltage Vref is, for example, a stable voltage of about 1.0 V that is generated by a band gap circuit, etc.

The edge pulse generating circuit 43 detects a rising edge and a falling edge of the signal ZCRS, and generates and outputs a signal ZPEDGE that change into a pulse waveform in response to a detected rising edge, and a signal ZNEDGE that change into a pulse waveform in response to a detected falling edge.

The SR flip-flop 44 (first holding circuit) is a circuit that memorizes whether the divided voltage Vdiv has exceeded the reference voltage Vref in a period during which the LEDs in the A group are driven. The signal ZCRS and the signal CMP are input to the AND circuit A1, and a signal output from the AND circuit A1 is input to a set terminal S of the SR flip-flop 44. Meanwhile, the signal ZPEDGE output from the edge pulse generating circuit 43 is input to a reset terminal R of the SR flip-flop 44. As a result, the level of a signal UD1 output from an output terminal Q of the SR flip-flop 44 is reset to low at the start of a period during which the LEDs in the A group are driven, and is set to high when the divided voltage Vdiv exceeds the reference voltage Vref in a period during which the LEDs in the A group are driven.

The SR flip-flop 45 (second holding circuit) is a circuit that memorizes whether the divided voltage Vdiv has exceeded the reference voltage Vref in a period during which the LEDs in the B group are driven. A signal given by reversing the signal ZCRS through the NOT circuit N2 and the signal CMP are input to the AND circuit A2, and a signal output from the AND circuit A2 is input to a set terminal S of the SR flip-flop 45. Meanwhile, the signal ZNEDGE output from the edge pulse generating circuit 43 is input to a reset terminal R of the SR flip-flop 45. As a result, the level of a signal UD2 output from an output terminal Q of the SR flip-flop 45 is reset to low at the start of a period during which the LEDs in the B group are driven, and is set to high when the divided voltage Vdiv exceeds the reference voltage Vref in a period during which the LEDs in the B group are driven.

The counter 46 (first voltage dividing ratio control circuit) is a circuit that, in response to the signal UD1 output from the SR flip-flop 44, updates a signal Q1 (first voltage dividing signal) for controlling a voltage dividing ratio at the voltage dividing circuit composed of the resistances R1 to R10 in a period during which the LEDs in the A group are driven. To an input terminal UD of the counter 46, the signal UD1 output from the SR flip-flop 44 is input. To a clock terminal C of the counter 46, the signal ZNEDGE output from the edge pulse generating circuit 43 is input. In the present embodiment, at a rising edge of the signal ZNEDGE, the signal Q1 is counted down when the signal UD1 is high, and is counted up when the signal UD1 is low.

The counter 47 (second voltage dividing ratio control circuit) is a circuit that, in response to a signal UD2 output from the SR flip-flop 45, updates a signal Q2 (second voltage dividing signal) for controlling a voltage dividing ratio at the voltage dividing circuit composed of the resistances R1 to R10 in a period during which the LEDs in the B group are driven. To an input terminal UD of the counter 47, the signal UD2 output from the SR flip-flop 45 is input. To a clock terminal C of the counter 47, the signal ZPEDGE output from the edge pulse generating circuit 43 is input. In the present embodiment, at a rising edge of the signal ZPEDGE, the signal Q2 is counted down when the signal UD2 is high, and is counted up when the signal UD2 is low.

In the present embodiment, each of the signals Q1 and Q2 is a 4-bit signal that shifts in digital value in a range of 0010 to 1011.

The selector 48, in response to the signal ZCRS, selects a signal corresponding to a group in which the LEDs to be driven belong out of the signals Q1 and Q2 output from the counters 46 and 47, and outputs the selected signal as a signal OS for controlling a voltage dividing ratio, to the decoder 49. In the present embodiment, the selector 48 outputs the signal Q1 from the counter 46 when the signal ZCRS is high, and outputs the signal Q2 from the counter 47 when the signal ZCRS is low.

The decoder 49 outputs a signal that turns on any one of the transfer gates G3 to G12, based on the signal SO output from the selector 48. In the present embodiment, the signal SO is a 4-bit signal that shifts in digital value in a range of 0010 to 1011. As the signal SO is counted down bit by bit from 1011 to 0010, a transfer gate to be turned on changes from G3 to G12 one by one in increasing order.

A circuit composed of the edge pulse generating circuit 43, the AND circuits A1 and A2, the NOT circuit N2, the SR flip-flops 44 and 45, the counters 46 and 47, the selector 48, and the decoder 49 is equivalent to a voltage dividing ratio control circuit of the present invention. A circuit composed of the selector 48 and the decoder 49 is one example of a voltage dividing ratio selecting circuit of the present invention.

The N-channel MOSFET M5 composing the drive control circuit 31 has a drain that is connected to the connection terminal T1, a source that is grounded via a resistance R30, and a gate that is connected to the drain and gate of the N-channel MOSFET M2 via a transfer gate G20 or is grounded via a transfer gate 21. When the transfer gate 20 is on and the transfer gate 21 is off, the N-channel MOSFET M5 is connected to the N-channel MOSFET M2 in current mirror connection. As a result, when the N-channel MOSFETs M2 and M5 are identical in size, the current flowing through the N-channel MOSFET M5 is the drive current Idrv, and the current flowing through the LEDs 20 and 21 connected to the connection terminal T1 is also the drive current Idrv. When the transfer gate 20 is off and the transfer gate 21 is on, the N-channel MOSFET M5 turns off, so that no current flows through the LEDs 20 and 21 connected to the connection terminal T1. In the present embodiment, therefore, in a period during which the signal ZCRS is high, a low-level signal output from the control register 33 to the drive control circuit 31 puts the LED 20 in an on-state, and a high-level signal output from the control register 33 to the drive control circuit 31 puts the LED 20 in an off-state. In a period during which the signal ZCRS is low, on the other hand, a low-level signal output from the control register 33 to the drive control circuit 31 puts the LED 21 in the on-state, and a high-level signal output from the control register 33 to the drive control circuit 31 puts the LED 21 in the off-state. Likewise, in the present embodiment, in a period during which the signal ZCRS is high, a low-level signal output from the control register 33 to the drive control circuit 32 puts the LED 22 in the on-state, and a high-level signal output from the control register 33 to the drive control circuit 32 puts the LED 22 in the off-state. In a period during which the signal ZCRS is low, on the other hand, a low-level signal output from the control register 33 to the drive control circuit 32 puts the LED 23 in the on-state, and a high-level signal output from the control register 33 to the drive control circuit 32 puts the LED 23 in the off-state.

Figure 4:
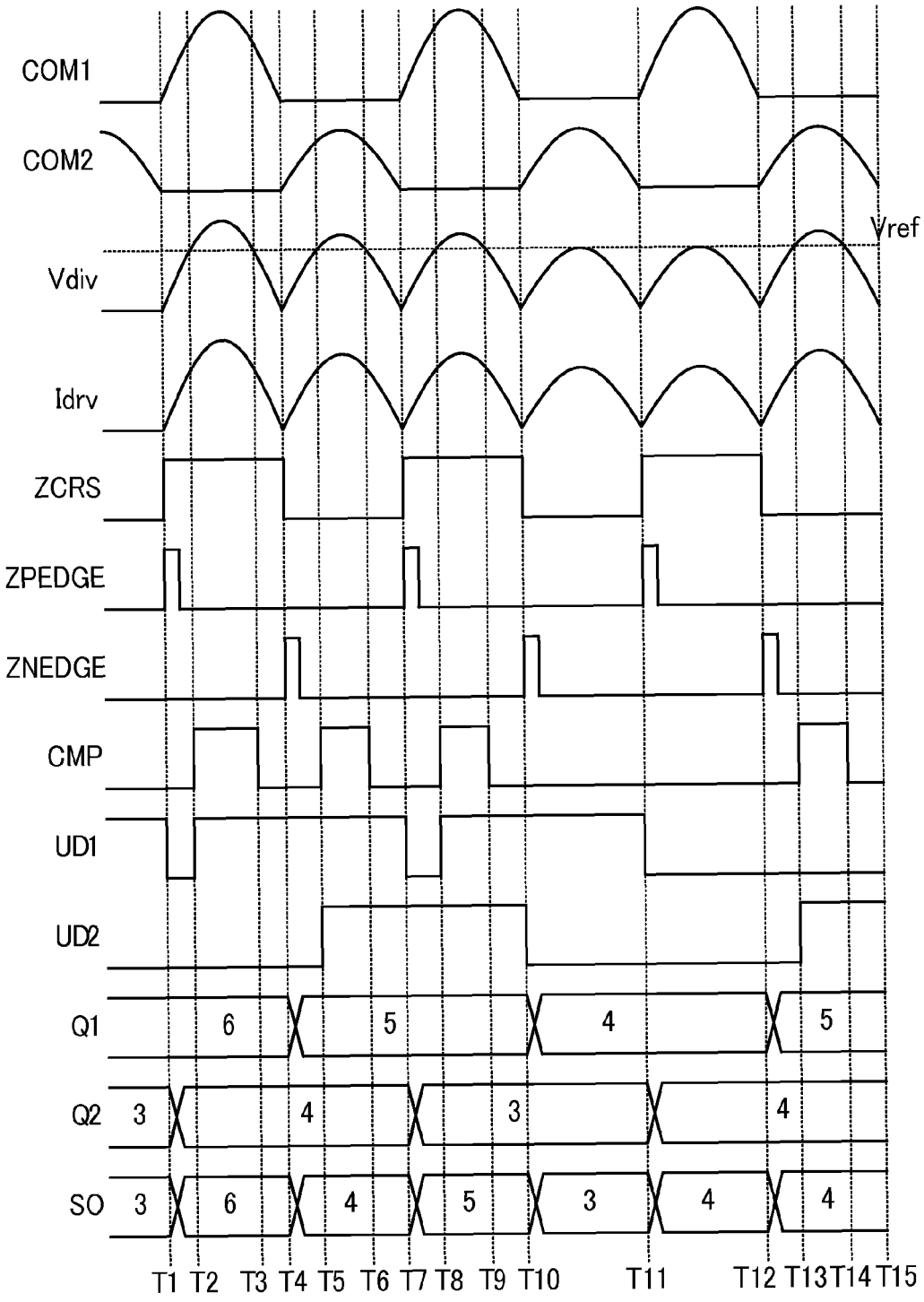
FIG. 4 is a timing chart of an example of the operation of the LED driving circuit.
Figure 5:
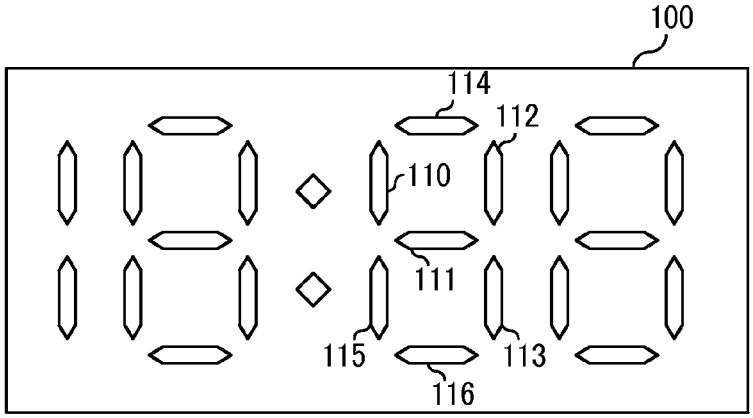
FIG. 5 depicts an example of a time display unit.
Figure 6:
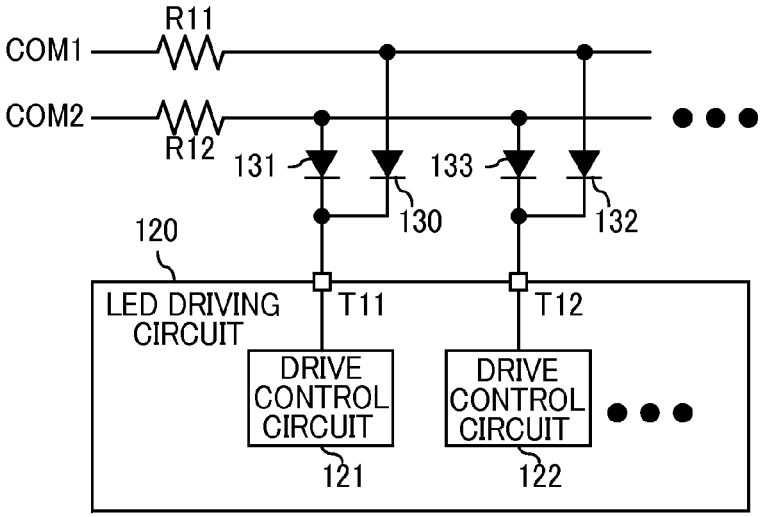
FIG. 6 depicts a general configuration example of the LED driving circuit.
Figure 7:
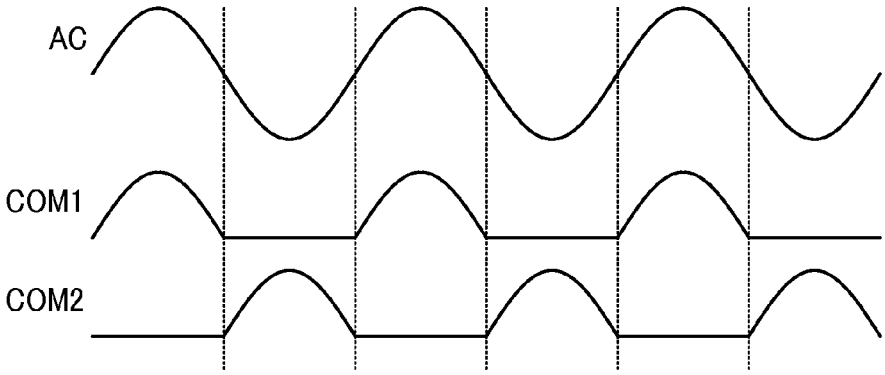
FIG. 7 depicts an example of the drive voltages.

FIG. 4 is a timing chart of an example of the operation of the LED driving circuit 10. As described above, the drive voltages COM1 and COM2 are generated by rectifying the alternating current AC by half-wave rectification. In the example of FIG. 4, a low-cost, small-sized transformer is used as a transformer that generates the drive voltages COM1 and COM2, and, due to the effect of the internal resistance of the transformer, the voltage levels of the drive voltages COM1 and COM2 fluctuate in correspondence to the number of LEDs to be turned on. In the example of FIG. 4, the signal ZCRS is low, the signal UD1 is low, the signal UD2 is low, the signal Q1 takes a value of "6" (0110), and the signal Q2 takes a value of "3" (0011) in the initial state of setting.

At a time T1, when the drive voltage COM1 becomes higher than the drive voltage COM2 to turn the signal ZCRS to high, a pulse is generated in the signal ZPEDGE, which resets the level of the signal UD1 to low. At this time, the signal ZCRS is high, so that the signal Q1 "6" is output as the signal OS. As a result, the divided voltage Vdiv is given as the voltage that is obtained by dividing the drive voltage COM1 at a voltage dividing ratio corresponding to the signal OS. Hence the LEDs in the A group are driven by the drive current Idrv that corresponds to the voltage level of the divided voltage Vdiv. Meanwhile, because the signal UD2 is low, the pulse of the signal ZPEDGE causes counting up of the signal Q2, which turns the signal Q2 into "4". The divided voltage Vdiv changes with a change in the drive voltage COM1, and when the divided voltage Vdiv becomes higher than the reference voltage Vref at a time T2, the level of the signal CMP goes high. At this time, a signal input to the set terminal S of the SR flip-flop 44 goes high. This sets the level of the signal UD1 to high. Afterward, when the divided voltage Vdiv becomes lower than the reference voltage Vref at a time T3, the level of the signal CMP goes low.

At a time T4, when the drive voltage COM2 becomes higher than the drive voltage COM1 to turn the signal ZCRS to low, a pulse is generated in the signal ZNEDGE. At this time, since the signal ZCRS is low, the signal Q2 "4" is output as the signal OS. As a result, the divided voltage Vdiv is given as the voltage that is obtained by dividing the drive voltage COM2 at a voltage dividing ratio corresponding to the signal OS. Hence the LEDs in the B group are driven by the drive current Idrv that corresponds to the voltage level of the divided voltage Vdiv. Meanwhile, because the signal UD1 is high, the pulse of the signal ZNEDGE causes counting down of the signal Q1, which turns the signal Q1 into "5". The divided voltage Vdiv changes with a change in the drive voltage COM2, and when the divided voltage Vdiv becomes higher than the reference voltage Vref at a time T5, the level of the signal CMP goes high. At this time, a signal input to the set terminal S of the SR flip-flop 45 goes high. This sets the level of the signal UD2 to high. Afterward, when the divided voltage Vdiv becomes lower than the reference voltage Vref at a time T6, the level of the signal CMP goes low.

In the period between a time T7 and a time T10, the LEDs in the A group are driven as in the period between the time T1 and the time T4. Because the signal Q1 has been counted down due to a change in the divided voltage Vdiv in the period between the time T1 and the time T4, the peak level of the divided voltage Vdiv in the period between the time T7 and the time T10 is lower than the peak level in the period between the time T1 and the time T4, and is closer to the level of the reference voltage Vref. The peak level of the divided voltage Vdiv is, however, still higher than the level of the reference voltage Vref in the period between the time T7 and the time T10, so that the signal Q1 is further counted down at the time T10 to become "4".

In the period between the time T10 and a time T11, the LEDs in the B group are driven as in the period between the time T4 and the time T7. Because the signal Q2 has been counted down due to a change in the divided voltage Vdiv in the period between the time T4 and the time T7, the peak level of the divided voltage Vdiv in the period between the time T10 and the time T11 is lower than the peak level in the period between the time T4 and the time T7. Thus, the divided voltage Vdiv becomes lower than the reference voltage Vref in the period between the time T10 and the time T11, so that the signal CMP remains low and the signal UD2 also remains low during this period.

In the period between the time T11 and a time T12, the LEDs in the A group are driven. Because the signal Q1 has been counted down to become "4", the peak level of the divided voltage Vdiv in the period between the time T11 and the time T12 is lower than the peak level in the period between the time T7 and the time T10, and is lower than the level of the reference voltage Vref. Because of this, the signal CMP remains low and the signal UD1 also remains low during this period. A pulse generated in the signal ZPEDGE at the time T11 causes counting up of the signal UD2, which turns the signal UD2 into "4".

In the period between the time T12 and a time T15, the LEDs in the B group are driven. Because the signal Q2 has been counted up to become "4", the peak level of the divided voltage Vdiv in the period between the time T12 and the time T15 is the same peak level in the period between the time T4 and the time T7. As a result, the level of the signal CMP goes high in the period between T13 and T14. When the LEDs in the A group are driven next time, therefore, the signal Q2 is to be counted down to change into "3". A pulse generated in the signal ZNEDGE at the time T12 causes counting up of the signal UD1, which turns the signal UD1 into "5". Because of this, when the LEDs in the A group are driven next time, the divided voltage Vdiv changes in the same manner as in the period between the time T7 and the time T10.

In this manner, according to the LED driving circuit 10, a voltage dividing ratio is adjusted so that the peak level of the divided voltage Vdiv goes to the reference voltage Vref, and the LEDs are driven by the drive current Idrv corresponding to the divided voltage Vdiv.

As a result, for example, if the fluctuation of the drive voltages COM1 and COM2 depending on the number of LEDs to be turned on is on a negligible level, the drive current Idrv is stable regardless of the number of LEDs to be turned on. This enables the remedy of luminance irregularity that occurs when the number of LEDs to be turned on is different in each group.

According to the LED drive circuit 10, for example, even when the drive voltages COM1 and COM2 fluctuate depending on the number of LEDs to be turned on because of the effect of the internal resistance of a transformer for generating the drive voltages COM1 and COM2, a voltage dividing ratio is adjusted so that the peak level of the divided voltage Vdiv goes to the reference voltage Vref in correspondence to the fluctuation of the drive voltages COM1 and COM2. Since the LEDs are driven by the drive current Idrv that corresponds to the divided voltage Vdiv, the fluctuation of the LED drive current Idrv is suppressed even when the drive voltages COM1 and COM2 fluctuate depending on the number of LEDs to be turned on. This enables the remedy of luminance irregularity.

Voltage dividing ratio control corresponding to the fluctuation of the drive voltages COM1 and COM2 can be carried out using the comparator 42 that compares the divided voltage Vdiv with the reference voltage Vref, and the counters 46 and 47 that update the signals Q1 and Q2 for controlling a voltage dividing ratio that is determined when the LEDs in each group are driven in response to the signal CMP output from the comparator 42.

According to the LED drive circuit 10, the selector 48 selects a signal corresponding to a group in which the LEDs to be driven belong out of the signals Q1 and Q2, and the decoder 49 decodes the selected signal, then a voltage dividing ratio is adjusted with the resistances R1 to R10. This means that the voltage dividing circuit is not provided for each group of LEDs, but one voltage dividing circuit is provided for shared use for both groups of LEDs. As a result, an increase in circuit scale can be suppressed compared to a case where the voltage dividing circuit is provided for each group of LEDs.

According to the LED drive circuit 10, the signal Q1 for controlling a voltage dividing ratio for the LEDs in the A group is updated while the LEDs in the B group are driven, and the signal Q2 for controlling a voltage dividing ratio for the LEDs in the B group is updated while the LEDs in the A group are driven. This inhibits the occurrence of such an accident that the drive current Idrv changes while the LEDs are on as a result of a change in a voltage dividing ratio. In other words, a luminance change occurring while the LEDs are on can be inhibited.

The above embodiments of the present invention are simply for facilitating the understanding of the present invention and are not in any way to be construed as limiting the present invention. The present invention may variously be changed or altered without departing from its spirit and encompass equivalents thereof.

What is claimed is:

1. An LED driving circuit for driving first to fourth LEDs, comprising:

a current generating circuit configured to generate a drive current corresponding to a voltage level of a drive voltage applied to anodes of the first to fourth LEDs so as to alternately drive the first and second LEDs and the third and fourth LEDs;

a first drive control circuit connected to cathodes of the first and third LEDs, and configured to drive the first or third LED with the drive current in response to a first control signal for controlling driving of the first or third LED; and a second drive control circuit connected to cathodes of the second and fourth LEDs, and configured to drive the second or fourth LED with the drive current in response to a second control signal for controlling driving of the second or fourth LED.

2. The LED driving circuit of claim 1, wherein the drive voltage includes a first drive voltage and a second drive voltage, the first and second drive voltages being obtained by rectifying an alternating voltage through half-wave rectification and having phases different from each other by 180 degrees, wherein the first drive voltage is applied to anodes of the first and second LEDs, and the second drive voltage is applied to anodes of the third and fourth LEDs, and wherein the current generating circuit includes:

a drive voltage selecting circuit configured to output a voltage corresponding to the first drive voltage in a period during which the first and second LEDs are driven, and a voltage corresponding to the second drive voltage in a period during which the third and fourth LEDs are driven;

a voltage dividing circuit configured to output a divided voltage obtained by dividing the voltage corresponding to the first or second drive voltage output from the drive voltage selecting circuit;

a voltage dividing ratio control circuit configured to control a voltage dividing ratio at the voltage dividing circuit so as to match a peak level of the divided voltage output from the voltage dividing circuit to a given level; and a voltage-to-current conversion circuit configured to generate the drive current corresponding to a voltage level of the divided voltage output from the voltage dividing circuit.

3. The LED driving circuit of claim 2, wherein the voltage dividing ratio control circuit includes:

a comparing circuit configured to compare the divided voltage output from the voltage dividing circuit with a reference voltage at the given level;

a first voltage dividing ratio control circuit configured to control the voltage dividing ratio at the voltage dividing circuit so as to match a level of the divided voltage to the given level in a period during which the first and second LEDs are driven, based on a comparison result from the comparing circuit in the period during which the first and second LEDs are driven; and a second voltage dividing ratio control circuit configured to control the voltage dividing ratio at the voltage dividing circuit so as to match a level of the divided voltage to the given level in a period during which the third and fourth LEDs are driven, based on the comparison result from the comparing circuit in the period during which the third and fourth LEDs are driven.

4. The LED driving circuit of claim 3, wherein the first voltage dividing ratio control circuit is configured to update and output a first voltage dividing signal for controlling the voltage dividing ratio at the voltage dividing circuit so as to match a level of the divided voltage to the given level in a period during which the first and second LEDs are driven, based on the comparison result from the comparing circuit in the period during which the first and second LEDs are driven; wherein the second voltage dividing ratio control circuit is configured to update and output a second voltage dividing signal for controlling the voltage dividing ratio at the voltage dividing circuit so as to match a level of the divided voltage to the given level in a period during which the third and fourth LEDs are driven, based on the comparison result from the comparing circuit in the period during which the third and fourth LEDs are driven; and wherein the voltage dividing ratio control circuit further includes a voltage dividing ratio selecting circuit configured to control the voltage dividing ratio at the voltage dividing circuit based on the first voltage dividing signal output from the first voltage dividing ratio control circuit in a period during which the first and second LEDs are driven, and to control the voltage dividing ratio at the voltage dividing circuit based on the second voltage dividing signal output from the second voltage dividing ratio control circuit in a period during which the third and fourth LEDs are driven.

5. The LED driving circuit of claim 4, wherein the voltage dividing ratio control circuit further includes:

a first holding circuit configured to hold the comparison result from the comparing circuit in a period during which the first and second LEDs are driven; and a second holding circuit configured to hold the comparison result from the comparing circuit in a period during which the third and fourth LEDs are driven, wherein the first voltage dividing ratio control circuit is configured to update the first voltage dividing signal based on the comparison result held on the first holding circuit in a period during which the first and second LEDs are not driven, and wherein the second voltage dividing ratio control circuit is configured to update the second voltage dividing signal based on the comparison result held on the second holding circuit in a period during which the third and fourth LEDs are not driven.

* * * * *